US006769337B2

(12) United States Patent
Sandberg et al.

(10) Patent No.: US 6,769,337 B2
(45) Date of Patent: Aug. 3, 2004

(54) SELF-CENTERING SLICER ORIFICE FOR FOOD LOAF SLICING MACHINE

(75) Inventors: Glenn Sandberg, Lockport, IL (US); Glen F. Pryor, Tinley Park, IL (US); Scott A. Lindee, Mokena, IL (US)

(73) Assignee: Formax, Inc., Mokena, IL (US)

( * ) Notice: Subject to any disclaimer, the term of this patent is extended or adjusted under 35 U.S.C. 154(b) by 0 days.

(21) Appl. No.: 10/162,431

(22) Filed: Jun. 4, 2002

(65) Prior Publication Data

US 2003/0221528 A1 Dec. 4, 2003

(51) Int. Cl.[7] ..... B26D 1/18; B26D 3/22

(52) U.S. Cl. ..... 83/413; 83/414; 83/466.1; 83/446; 83/932

(58) Field of Search ..... 83/932, 412, 413, 83/466.1, 446

(56) References Cited

U.S. PATENT DOCUMENTS

| | | | | |
|---|---|---|---|---|
| 4,428,263 | A | 1/1984 | Lindee et al. | |
| 4,805,503 | A | 2/1989 | Yokokawa | |
| 5,649,463 | A | 7/1997 | Lindee et al. | |
| 5,704,265 | A | 1/1998 | Johnson et al. | |
| 5,974,925 | A | 11/1999 | Lindee et al. | |
| 6,318,225 | B1 * | 11/2001 | Longoria | 83/454 |
| 6,532,851 | B2 * | 3/2003 | Moss et al. | 83/466.1 X |
| 2002/0083816 | A1 * | 7/2002 | Krauss | 83/932 |

FOREIGN PATENT DOCUMENTS

| | | |
|---|---|---|
| EP | 0 713 753 A2 | 5/1996 |
| WO | WO 99/08844 | 2/1999 |

* cited by examiner

*Primary Examiner*—Charles Goodman
(74) *Attorney, Agent, or Firm*—The Law Office of Randall T. Erickson, P.C.

(57) ABSTRACT

An improved orifice plate assembly for a loaf slicing machine, the orifice plate assembly located adjacent to a moving slicing blade includes a frame defining an opening and a first orifice-defining member and a second orifice-defining member slidably mounted together slidably on the frame. The first orifice-defining member and the second orifice-defining member, together define an orifice. An adjustment mechanism is operatively connected to the frame and to each of the first and second orifice-defining members, the adjustment mechanism when adjusted changes the orifice dimension between the first and second orifice-defining members without substantially changing a centerline location of the orifice. The adjustment mechanism includes a stud fixed to the first orifice-defining member, and two links pivotally mounted to the frame and engaged to two rods fixed to the second orifice-defining member. The stud is engaged to one end of the links and the rods are engaged to a respective other end of the links such that a movement of the stud inwardly pivots the links to draw the second orifice-defining member toward the first orifice-defining member.

18 Claims, 8 Drawing Sheets

SELF-CENTERING SLICER ORIFICE FOR FOOD LOAF SLICING MACHINE

BACKGROUND OF THE INVENTION

There are many different kinds of food loaves in a wide variety of shapes and sizes. Meat loaves are made from various different meats, including ham, pork, beef, lamb, turkey, fish, and others. Meat loaves come in different shapes such as round, square, rectangular, oval, and others, and in different lengths up to six feet or longer. The cross-sectional sizes of the loaves can be dissimilar, the maximum transverse dimension may be as small as 1½ inches or as large as 10 inches. Loaves of cheese or other foods are also available in varying compositions, in a wide range of shapes, lengths, and transverse sizes.

Food loaves are typically sliced, the slices grouped in accordance with a particular weight requirement, and then packaged and sold. The number of slices in a group may vary, depending on the size and consistency of the food loaf and on the desires of the producer, the wholesaler, or the retailer. For some products, neatly aligned stacked slice groups are preferred. For others, slice groups can be shingled so that a purchaser can see a part of every slice.

Examples of known high-speed food loaf slicing machines are described in U.S. Pat. Nos. 5,974,925; 4,805,503 and 4,428,263. U.S. Pat. Nos. 5,649,463; 5,704,265; EP 0 713 753; or WO 99/08844, also disclose high-speed food loaf slicing machines. Slicing apparatus are also embodied in the FORMAX FX180 Slicer available from Formax, Inc. of Mokena, Ill., U.S.A.

As described in U.S. Pat. No. 5,974,925, a versatile high-speed slicing machine is capable of slicing two, three, or more loaves from a single cyclically driven knife blade, with accommodation for food loaves that vary in transverse dimension. The machine is also capable of varying the slice thickness for groups of slices cut simultaneously from different loaves.

The slicing machine includes a slicing station comprising a knife blade, a knife blade drive for moving the blade along an arcuate cutting path, and an inclined loaf support for supporting a food loaf for movement by gravity along a loaf path intersecting the cutting path. Two short loaf feed conveyors are arranged along the loaf path, the short conveyors being spaced from each other and engaging opposite sides of the food loaf immediately ahead of the cutting path. A variable speed conveyor drive circulates the two short conveyors at variable speeds to vary thickness of slices cut from the loaves.

An orifice plate is arranged adjacent to the cutting path. The orifice plate includes two orifices for gripping and guiding the two loaves individually into the cutting path during the slicing operation. The orifices of the orifice plate are adjustable in size by use of slide members moved by rods, the slide members each forming part of a rim of an orifice. Adjustment of orifice size to conform to varying loaf transverse dimensions is taken up from one side, by moving a respective rod from the outside. By reducing or enlarging the orifice using this arrangement, the location of the centerline of the orifice is moved.

U.S. Pat. No. 4,428,263 also discloses an adjustable orifice size in a slicing machine. The automatic adjustment of the orifice size is also taken up from one direction and as a result of orifice size adjustment; the location of the centerline of the orifice is moved.

The present inventors have recognized that it would be desirable to provide a slicing machine that would accommodate orifice size adjustment without changing the location of the centerline of the loaf being sliced. The present inventors have recognized that it would be desirable to provide a slicing machine that could accommodate loaves of varying lateral dimension while at the same time maintaining a constant centerline of the loaf being sliced such that slices cut from the loaf can be neatly stacked or shingled along a common centerline on a receiving surface.

SUMMARY OF THE INVENTION

The invention provides an adjustable orifice member for guiding one or more food loaves into the cutting path of a cyclically operating slicing blade. The invention includes the orifice member being automatically adjustable to grip food loaves of varying lateral dimension while also maintaining a constant orifice centerline.

The invention is particularly advantageous in that slices cut from a food loaf having a constant orifice centerline can be received on a receiving surface in a constant and precise centerline alignment. Straight stacks can be accumulated in a reliable manner on a stationary receiving surface and shingled stacks can be formed along a straight longitudinal line on a receiving conveyor. This provides for a more attractive arrangement of slices for packaging and sale.

The invention provides a slicing machine that is particularly adapted to slice two loaves simultaneously wherein the two loaves are gripped and guided by an orifice plate having dual, automatically adjusted orifices.

According to an exemplary embodiment, an orifice assembly includes one or more subassemblies that each include a slide housing mounted for sliding on a stationary frame, and a slide member mounted slidably on the slide housing. The slide housing and slide member together define an orifice.

A plunger is secured to the slide member and is acted upon by an actuator that exerts a continuous inward force on the slide member. A linkage is operatively connected to the plunger and to the slide housing. The linkage is configured to draw the slide housing in an outward direction by an amount equal to the inward movement of the slide member during orifice contraction. The linkage also ensures that during orifice expansion by force from the loaf against the slide housing and slide member, against the urging of the actuator, the slide housing and slide member move by an equal amount. By drawing the slide housing and the slide member together, or by allowing the slide housing and the slide member to move apart, by equal distances, the location of the orifice centerline remains constant.

The invention overcomes the difficulties of prior orifice adjusting arrangements wherein the lateral dimension of the orifice is adjusted from one side only wherein the adjustment effectively changes the location of the centerline of the orifice.

Numerous other advantages and features of the present invention will be become readily apparent from the following detailed description of the invention and the embodiments thereof, from the claims and from the accompanying drawings.

DETAILED DESCRIPTION OF THE PREFERRED EMBODIMENTS

Figure 1:
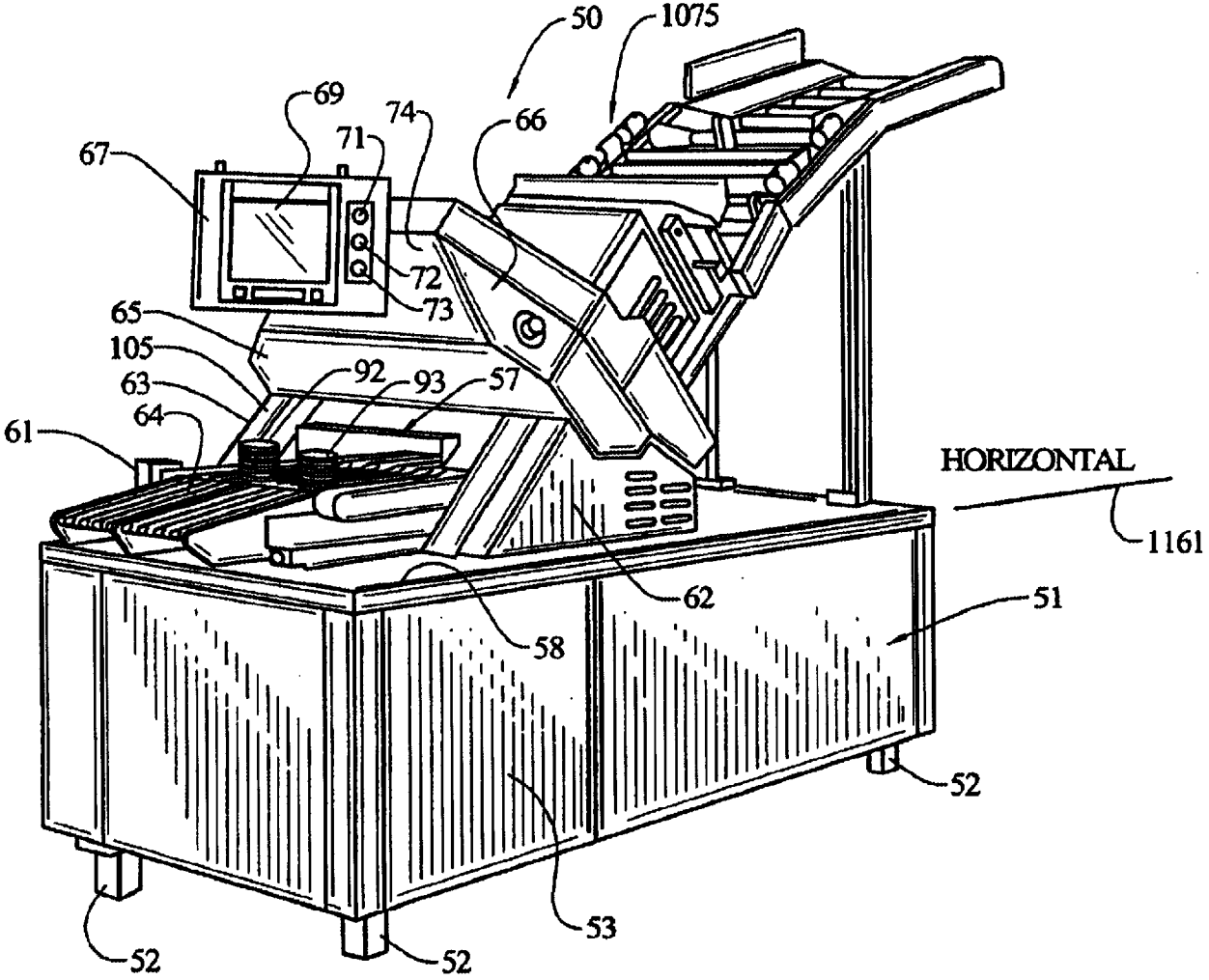
FIG. 1 is a perspective view of a high-speed slicing machine incorporating the present invention.

While this invention is susceptible of embodiment in many different forms, there are shown in the drawings, and will be described herein in detail, specific embodiments thereof with the understanding that the present disclosure is to be considered as an exemplification of the principles of the invention and is not intended to limit the invention to the specific embodiments illustrated.

The present invention is an improvement in slicing machines of the type described in U.S. Pat. Nos. 5,974,925; 4,805,503 and 4,428,263, all herein incorporated by reference. Particularly, the invention provides an improvement in the orifice member that grips and guides food loaves into the slicing path of a slicing blade.

FIG. 1 illustrates a food loaf slicing machine 50 which includes a continuous loaf feed mechanism constructed in accordance with a preferred embodiment of the present invention. The slicing machine 50 comprises a base 51 which is mounted upon four fixed pedestals or feet 52 and has a housing or enclosure 53 surmounted by a top 58. The slicing machine 50 includes an output conveyor drive 61 utilized to drive an output conveyor/classifier system 64. The slicing machine 50 further includes a computer display/touchscreen 69 in a cabinet 67 that is pivotally mounted on, and supported by, a support that projects outwardly from a member 74 that is a part of a housing of slicing station 66.

The upper right-hand portion of slicing machine 50 comprises a continuous automated loaf feed mechanism 1075. Automated loaf loading into mechanism 1075, may be provided on either or both sides of machine 50.

In operation, slicing machine 50 produces a series of stacks 92 of food loaf slices that are transported outwardly of the machine by conveyor/classifier system 64. The machine 50, when slicing two food loaves, also produces a series of stacks 93 of food loaf slices that also move outwardly of the machine on conveyor system 64. The stacks 92 and 93 are each shown as a straight stack of slices from a food loaf having a round cross-section. Alternatively, the groups of slices can be overlapping, shingled groups of slices instead of having the illustrated straight stack configuration.

Figure 2:
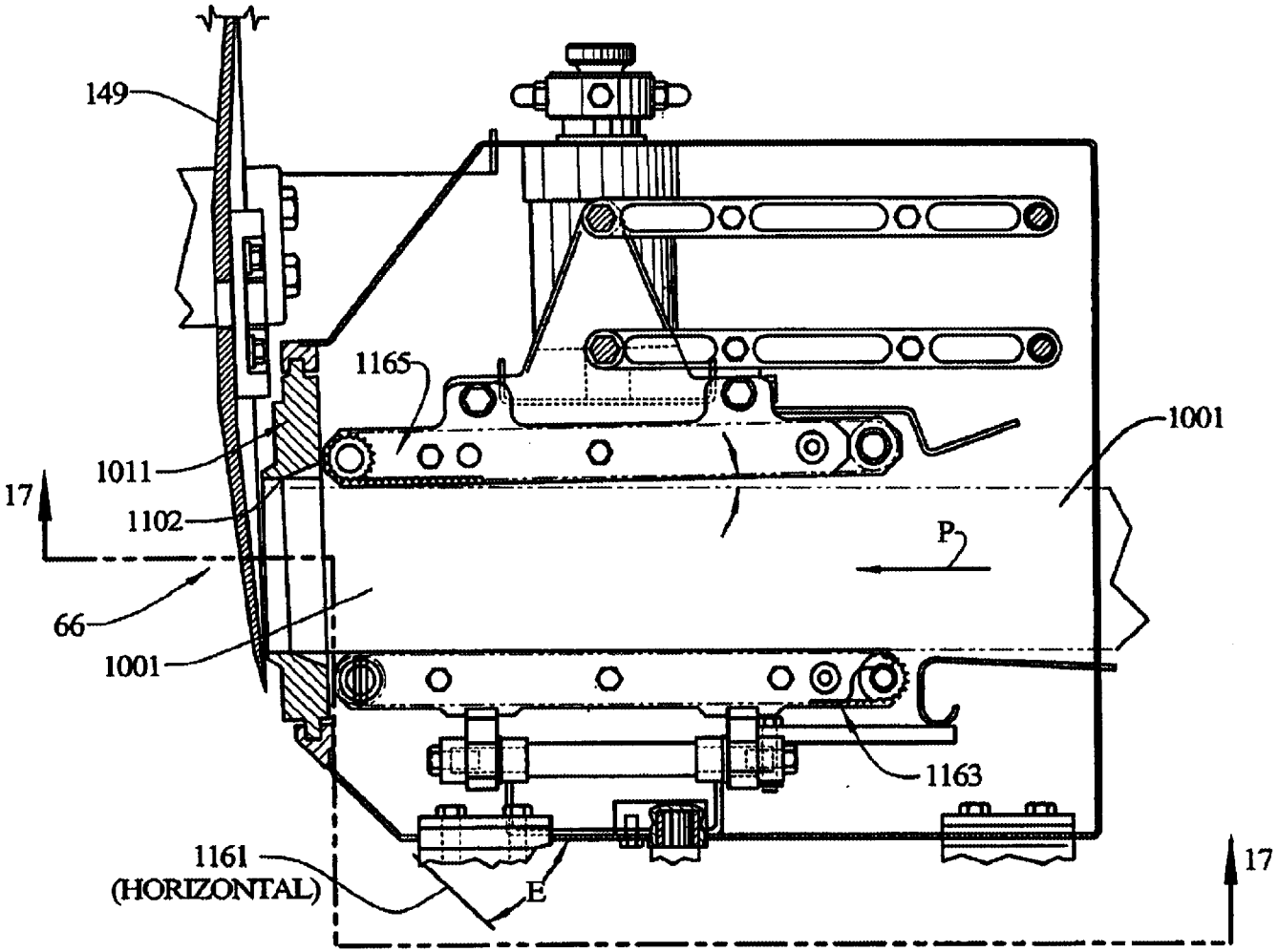
FIG. 2 is a fragmentary, diagrammatic sectional view of the junction between the loaf feed mechanism and the slicing station of the slicing machine of FIG. 1.

FIG. 2 provides a sectional view of the portion of continuous food loaf feed mechanism 1075 immediately ahead of slicing station 66 and its continuously rotating knife blade 149. The blade 149 may be of a circular configuration, driven in both a rotating motion and an orbiting motion, as in the slicing stations described in greater detail in prior patents and publications U.S. Pat. Nos. 5,649,463; 5,704,265; EP 0 713 753; or WO 99/08844, herein incorporated by reference. Alternatively, the blade 149 may be of an arcuate configuration, with rotating motion only, as described in at least one of the aforementioned patents and publications. Blade 149 cuts slices from the front end of a food loaf 1001 that is advanced through an orifice assembly 1011 as described below.

FIG. 2 has been tilted through an angle approximately 45 degrees so that it can be more readily described on the drawing sheet; horizontal is indicated by line 1161.

The movement of loaf 1001, during slicing, is in the direction of arrow P toward slicing station 66. The rate at which loaf 1001 moves into slicing station 66 is controlled by a pair of short conveyors 1163 and 1165, which have a common drive and operate at the same speed.

Loaf feed mechanism 1075 can include another pair of short conveyors, a lower short conveyor, and an upper short conveyor, substantially identical to the conveyors 1163, 1165, and arranged in parallel to the conveyors 1163, 1165 on the near side of the slicing machine, for feeding a second loaf 1002 into the slicing station simultaneously with the first loaf 1001.

In this specification the term "short", as applied to the conveyors that feed loaves into the slicing station 66 of the machine, refers to the length of the conveyors in the loaf feed direction, arrow P. The conveyor length is not critical; a typical length for conveyors 1163 and 1165, FIG. 2, is about twelve inches (30 cm). The upper surface of the lower short conveyor 1163 is parallel to the direction of loaf feed, arrow P. The lower conveyor 1163 engages the bottom surface of loaf 1001 and is aligned with the bottom of orifice 1102 in orifice assembly 1011. The location of conveyor 1163 can be adjusted vertically in a direction normal to arrow P, to accommodate food loaves of different sizes.

The positions of the upper conveyor 1165 is also made adjustable toward and away from food loaves so that feed mechanism 1075 can accommodate a variety of different sizes and shapes of food loaves.

Figure 3:
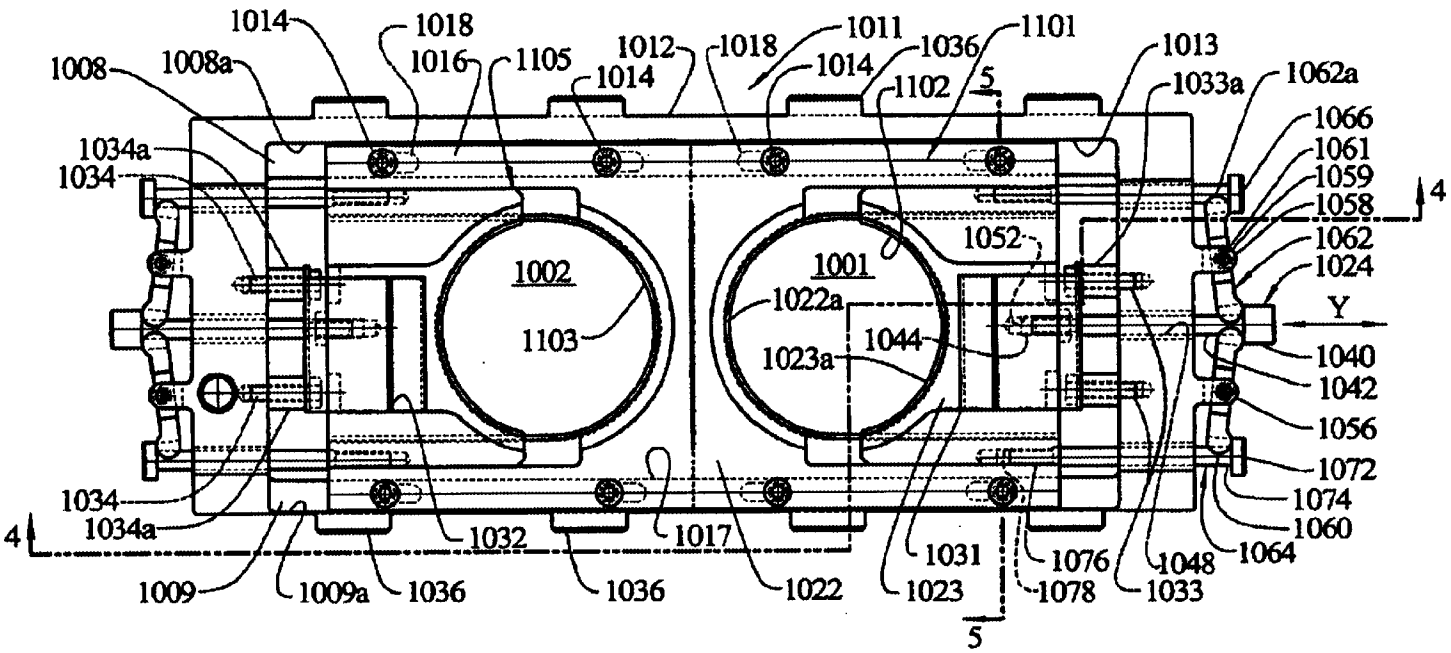
FIG. 3 is a rear view of an adjustable orifice assembly of the present invention.
Figure 4:
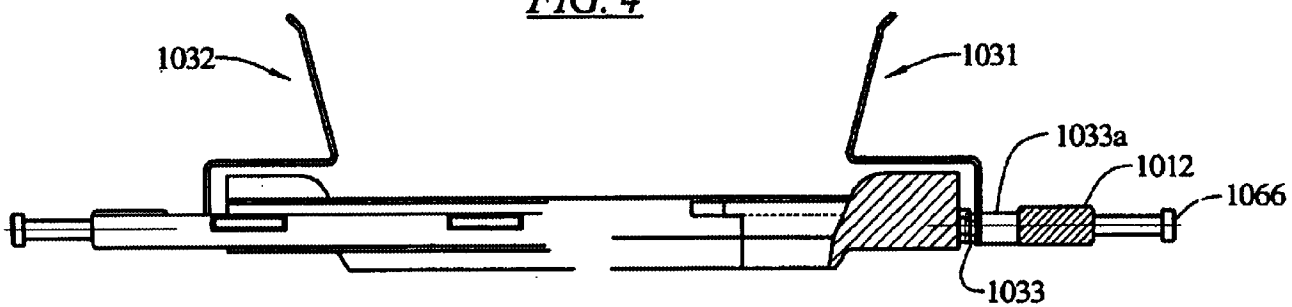
FIG. 4 is a fragmentary, diagrammatic sectional view taken generally along line 4—4 of FIG. 3.
Figure 6:
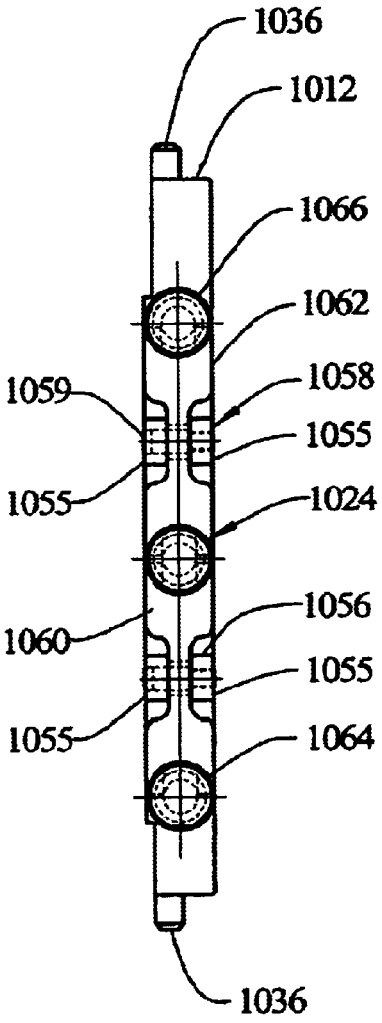
FIG. 6 is a right side view of the assembly shown in FIG. 3.
Figure 5:
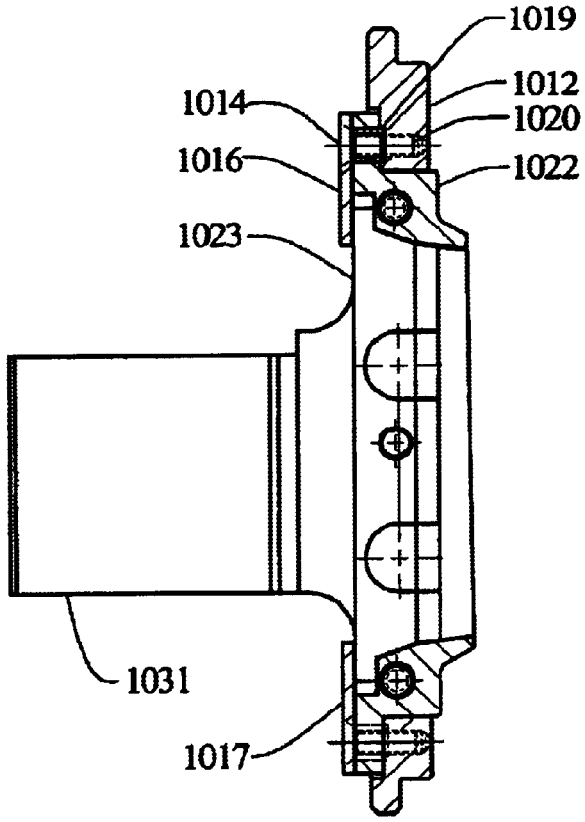
FIG. 5 is a sectional view taken generally along line 5—5 of FIG. 3.

FIG. 3 illustrates the assembled orifice assembly 1011, particularly when used to slice two loaves 1001, 1002. FIGS. 4–16 illustrate the details of components of orifice assembly 1011 used in slicing machine 50.

Figure 17:
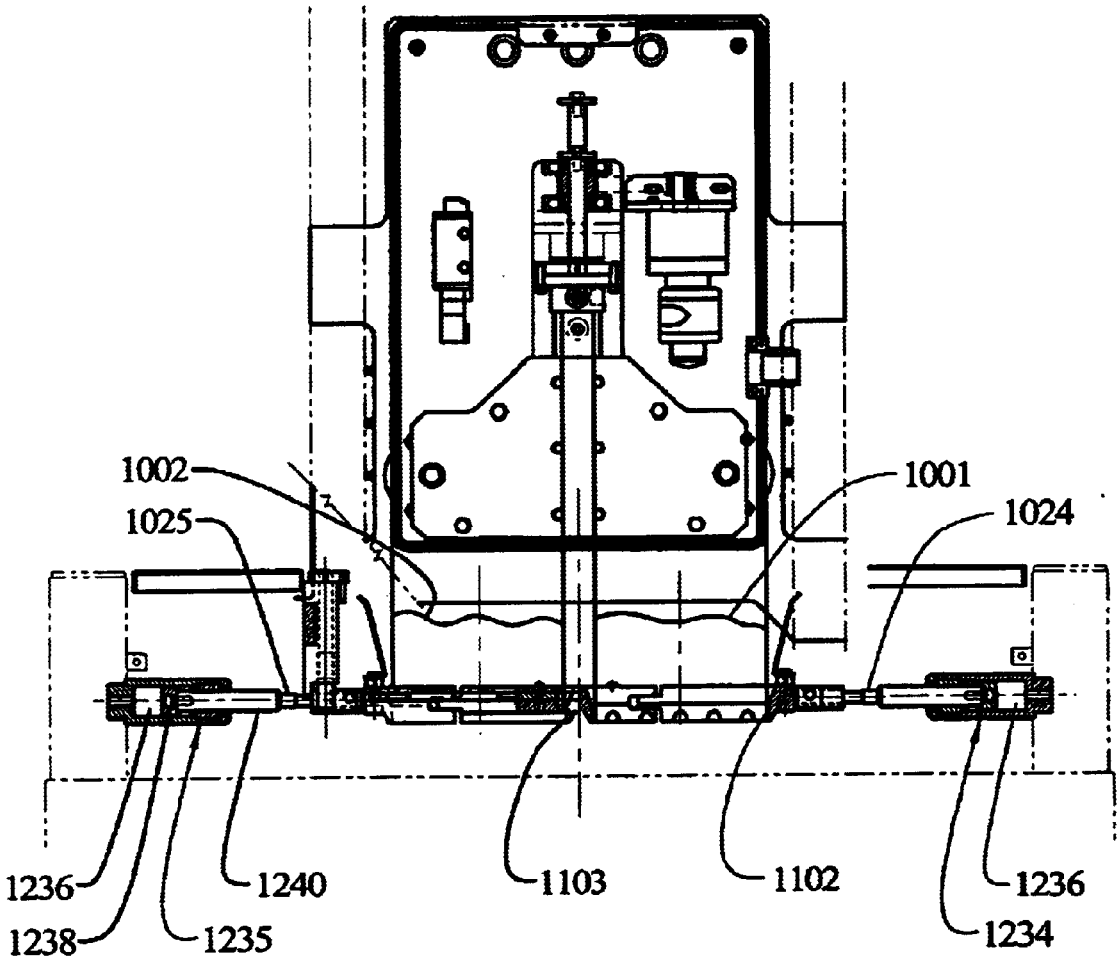
FIG. 17 is a fragmentary, diagrammatic sectional view taken generally along line 17—17 of FIG. 2.

FIG. 3 illustrates the food loaf (upstream) side of assembly 1011. Assembly 1011 includes far and near side orifice-defining subassemblies 1101, 1105 respectively, having a far side orifice 1102 and a near side orifice 1103 respectively into which loaves 1001 and 1002 enter as shown in FIG. 17.

Far side orifice-defining subassembly 1101, is illustrative of both subassemblies 1101 and 1105, the subassembly 1105 being configured in mirror image fashion across a vertical center plane. Therefore, the subassembly 1105 need not be described in detail.

The size and shape of the orifice 1102 depends on the size and shape of the loaves (loaf 1001) being sliced. For loaves of different sizes or shapes, a different, conforming orifice member (not illustrated) should be used is Typically, for a round food loaf, such as illustrated loaf 1001, the diametrical size of orifices 1102 may range from 2 in. (five cm) to about 5½ inches (14 cm). Other size ranges may be employed, depending on the needs of the user of slicing machine 50. Similar size ranges may be established for food loaves of square, rectangular, or other cross-sectional configuration.

The orifice assembly 1011 includes a rectangular frame 1012 having a relatively large rectangular central opening 1013 and upper and lower recessed ledges 1008, 1009 adjacent to perpendicular wall surfaces 1008*a*, 1009*a*. The far side orifice subassembly 1101 is mounted in opening 1013 by appropriate means such as a plurality of screws or other fasteners 1014. Fasteners 1014 mount two guide plates 1016 and 1017 on the frame 1012.

Guide plates 1016 and 1017 engage the upper and lower edges, respectively, of a slide housing 1022 and a slide member 1023, slidingly engaged to the slide housing 1022. The fasteners 1014 penetrate elongated holes 1018 through the slide housing 1022 and engage into threaded bores 1020 in the recessed ledges 1008, 1009 of the frame 1012. The slide housing 1022 is guided for sliding on the ledges 1008, 1009 by the perpendicular wall surfaces 1008*a*, 1009*a* of the frame 1012 and by the fasteners 1014 within the elongated holes 1018. For this reason, each of the fasteners 1014 can include a bearing sleeve 1019 (FIG. 5) within the elongated holes 1018 to ensure reduced-friction and a precise sliding within the holes 1018. The slide member 1023 is captured by the guide plates 1017 on the slide housing 1022, but permitted to slide laterally with respect to the slide housing 1022.

The slide housing 1022 and the slide member 1023 include rim regions 1022*a*, 1023*a* that together define the orifice 1102. The slide housing 1022 and the slide member 1023 can be composed of machinable plastic so that the face of the orifice can be sliced away by the cutting blade (blade 149) with continued use and will always present a smooth, planar surface at the entrance to the slicing stations.

A plunger 1024 operatively connected to the slide housing 1022 and to the slide member 1023 is used to adjust the slide housing and member in the direction of arrow Y to modify the size of orifice 1102. Similarly, a plunger 1025 affixed to the assembly 1105 is moved to vary the size of orifice 1103.

The plunger 1024 is in the form of a headed stud, having a head 1040, a shaft 1042, and a threaded end 1044. The shaft slidingly penetrates a bore 1048 through the frame 1012 and is threadedly engaged into a threaded bore 1052 of the slide member 1023.

The frame 1012 includes two pairs of lugs 1055 (FIG. 6), each pair forming a yoke or trunnion 1056, 1058 respectively. The yokes are arranged spaced equidistantly from the plunger 1024. One link of a pair of links 1060, 1062 is pivotally fastened to each yoke 1056, 1058. Rods 1064, 1066 in the form of headed studs are equidistantly spaced from the plunger 1024, outside of the yokes 1056, 1058. Each rod 1064, 1066 includes a head 1072, a shaft 1074 and a threaded end 1076. The rods 1064, 1066 slidingly penetrate the frame 1012 and are each threadedly engaged to a threaded bore 1078 in the slide housing 1022.

Each link 1060, 1062 includes fork ends 1060*a*, 1062*a* respectively on opposite ends of each link. The fork ends 1060*a*, 1062*a* underlie the head 1040 of the plunger and an adjacent head 1072 of a respective rod 1064, 1066.

In operation, to constrict the orifice 1102, inward movement of the plunger 1024 driven by an actuator (FIG. 17) drives the slide member 1023 to the left as shown in the FIG. 3. Simultaneously, the links 1060, 1062 pivot causing the rods to be driven to the right as viewed in FIG. 3, which pulls the slide housing 1022 to the right towards the slide member 1023. The slide housing 1022 is moved to the right by an amount equal to the movement of the slide member 1023 to the left. Hence, the location of the centerline of the orifice 1102 remains constant.

Force from a loaf, larger than the orifice 1102, entering the orifice, will expand the orifice by drawing the rods 1064, 1066 to the left, which causes the links 1060, 1062 to pivot and push the plunger 1024 against force from the actuator (FIG. 17), to the right an equal amount. The orifice centerline remains constant.

A resilient loaf guide 1031 for loaf 1001 is mounted on the frame 1012 by appropriate means such as screws or like fasteners 1033 via spacers 1033*a*. A like resilient loaf guide 1032 engages the side of loaf 1002 and is mounted on the frame 1012 by screws or like fasteners 1034 via spacers 1034*a*. Frame 1012 has a plurality of projections 1036 to locate assembly 1011 quickly and accurately in openings provided around the entrance to the slicing station of machine 50.

Figure 7:
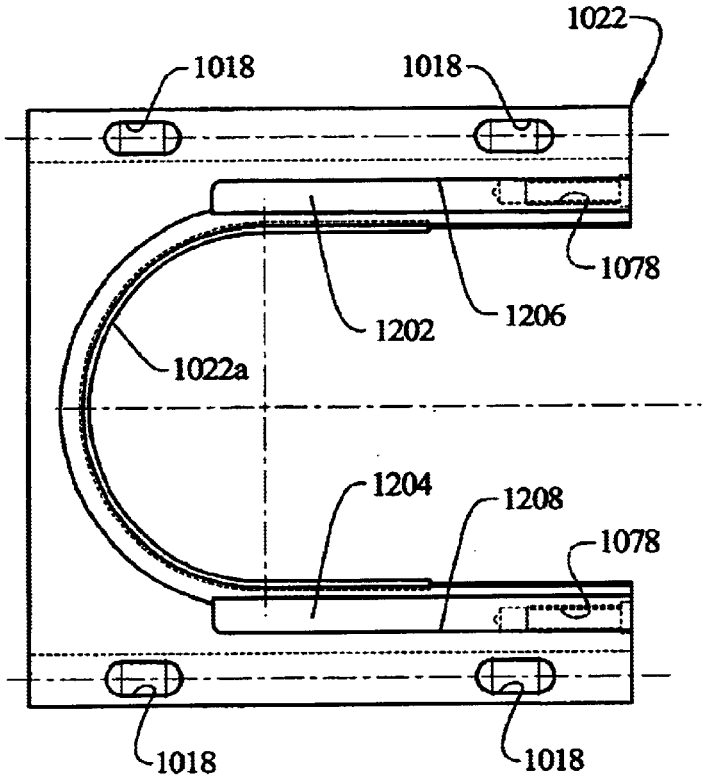
FIG. 7 is an elevational view of a slide housing of the assembly shown in FIG. 3.
Figure 8:
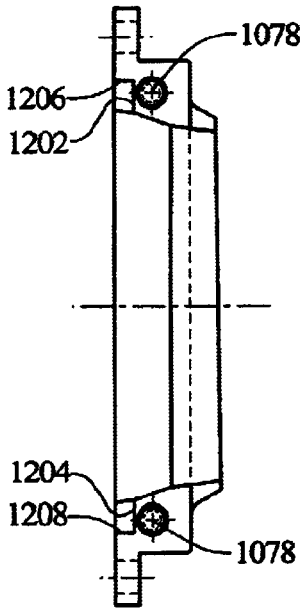
FIG. 8 is a right side view of the slide housing shown in FIG. 7.

FIGS. 7 and 8 illustrate the slide housing 1022. The slide housing 1022 includes recessed ledges 1202,1204, sized and space to receive the slide member 1023 on the ledges to be guided thereon for sliding movement by perpendicular wall surfaces 1206,1208 adjacent to the ledges 1202,1204.

Figure 9:
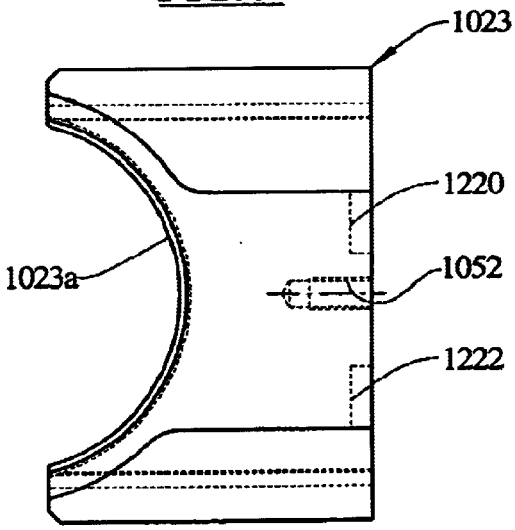
FIG. 9 is an elevational view of slide member of the assembly shown in FIGS. 3.
Figure 10:
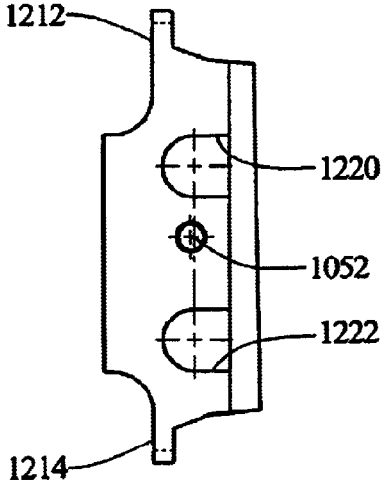
FIG. 10 is a right side view of the slide member shown in FIG. 9.
Figure 11:
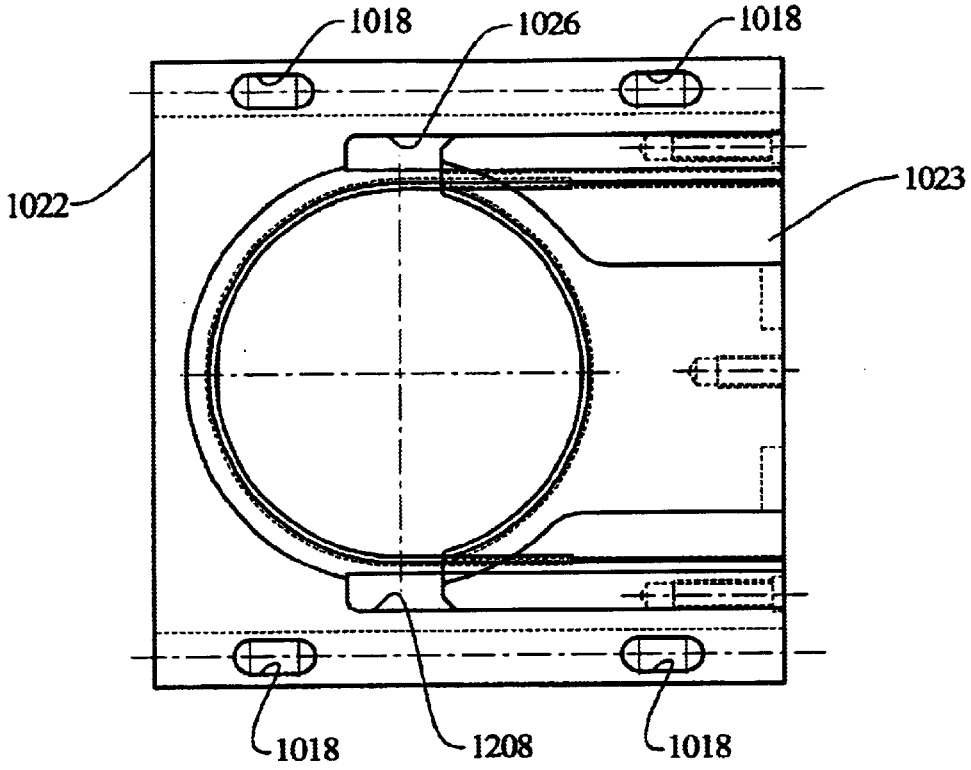
FIG. 11 is an elevational view of a subassembly of the slide housing and slide member of FIGS. 7 and 9.
Figure 12:
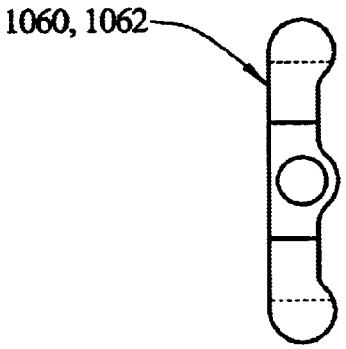
FIG. 12 is an elevational view of a link of the assembly of FIG. 3.
Figure 13:
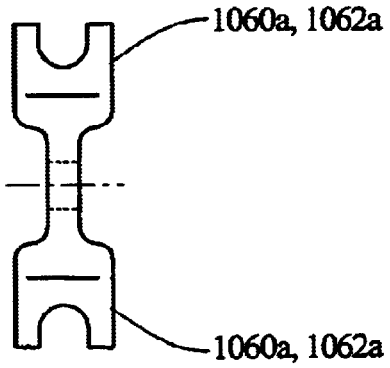
FIG. 13 is a rights side view of the link shown in FIG. 12.
Figure 15:
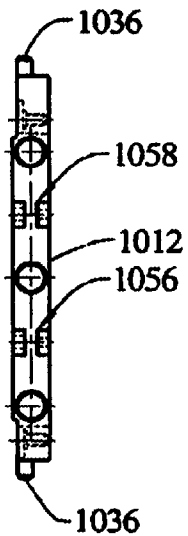
FIG. 15 is a right side view of the frame of FIG. 14.
Figure 14:
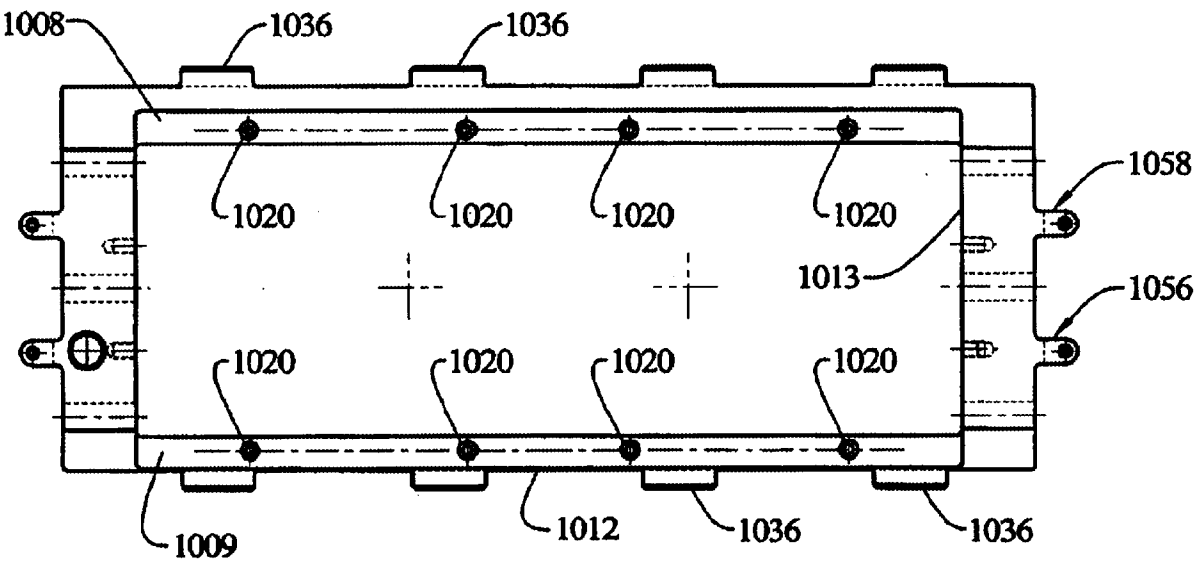
FIG. 14 is an elevational view of a frame of the assembly of FIG. 3.

FIGS. 9 and 10 illustrate the slide member 1023. The slide member includes flanges 1212, 1214 for being guided by the wall surfaces 1206,1208 and for sliding on the ledges 1202, 1204 of the slide housing. The slide member also includes recesses 1220, 1222 provided for clearance between the slide member and the fasteners 1033.

Figure 16:
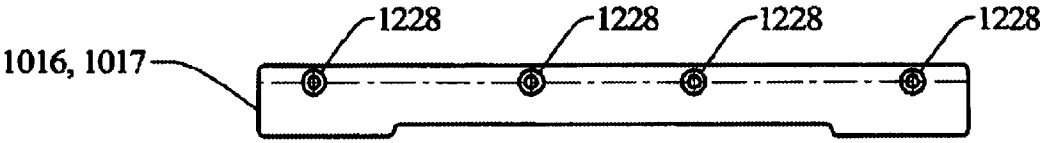
FIG. 16 is an elevational view of a guide plate of the assembly of FIG. 3.

FIG. 16 illustrates the guide plates 1016, 1017. The guide plates are flat plates having plain holes 1228 positioned to register with the holes 1020 in the frame 1012.

FIG. 17 illustrates the plungers 1024, 1025 being pressed by actuators in the form of pneumatic cylinders 1234, 1235 respectively. Each cylinder 1234, 1235 includes a chamber 1236 subjected to air pressure. A piston 1238 urges a rod 1240 which presses the respective plunger 1024, 1025. The rods 1240 act to constrict or alternately to resist expansion of the respective orifices.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

The invention claimed is:

1. In a slicing machine for slicing loaves having a moving slicing blade and an orifice plate adjacent to a cutting path of the blade, the improvement comprising an orifice assembly having:

a frame defining an opening;

a first orifice-defining member and a second orifice-defining member mounted together slidably on said frame, together defining an orifice therebetween, said orifice in registry with said opening of said frame and arranged to receive a loaf therethrough for slicing; and an adjustment mechanism operatively connected to said frame and to each of said first and second orifice-defining members, said adjustment mechanism when adjusted changes the orifice dimension between said first and second orifice-defining members without substantially changing a centerline location of said orifice.

2. The improvement according to claim 1, wherein said adjustment mechanism comprises a stud connected to said first orifice-defining member, and at least one link pivotally mounted to said frame, said stud engaged to one end of said link and said second orifice-defining member engaged to a respective other end of said link such that an inward movement of said stud pivots said link to draw said second orifice-defining member toward said first orifice-defining member.

3. The improvement according to claim 2, wherein said adjustment mechanism comprises at least one rod fixed to said second orifice-defining member and having a head in engagement with said second end of said link.

4. The improvement according to claim 2, wherein said adjustment mechanism comprises two links, each link pivotally connected to said frame on opposite sides of said stud, and two rods fixed to said second orifice-defining member on opposite sides of said stud, outside ends of said links engaged to heads of said rods and inside ends of said links engaged to said stud, inward movement of said stud drawing said rods outwardly to cause said first orifice-defining member and said second orifice-defining member to slide toward each other to decrease a width of said orifice.

5. The improvement according to claim 1, wherein said adjustment mechanism comprises an elongated member connected to said first orifice-defining member, and at least one link pivotally mounted to said frame, said elongated member engaged to one end of said link and said second orifice-defining member engaged to a respective other end of said link such that an inward movement of said elongated member pivots said link to draw said second orifice-defining member toward said first orifice-defining member.

6. The improvement according to claim 1, wherein said adjustment mechanism comprises a member that when translated with respect to said frame draws said first and second orifice-defining members together.

7. The improvement according to claim 1, wherein said adjustment mechanism comprises a movement conversion means and a driving means, said driving means arranged to move in a first direction and in an opposite second direction, and said movement conversion means coordinated with said driving means to draw said first and second orifice-defining members together when said driving means moves in said first direction and to separate said first and second orifice-defining members when said driving means moves in said second direction.

8. The improvement according to claim 7, wherein said driving means comprises an elongated member and said improvement comprises a pneumatic cylinder having an extendable rod engaged to a portion of said elongated member, extension of said rod under pneumatic pressure drives said elongated member in said first direction to draw said first and second orifice-defining members together.

9. The improvement according to claim 8, wherein said movement conversion means comprises a link pivotally connected to said frame and operatively connected at one end to said first orifice-defining member and at an opposite end to the second orifice defining member.

10. The improvement according to claim 7, wherein said driving means comprises an elongated member and said improvement comprises an actuator engaged to a portion of said elongated member, said actuator urging said elongated member in said first direction to draw said first and second orifice-defining members together.

11. The improvement according to claim 10, wherein said movement conversion means comprises a link pivotally connected to said frame and operatively connected at one end to said first orifice-defining member and at an opposite end to the second orifice defining member.

12. The improvement according to claim 1, wherein said adjustment mechanism comprises an urging means operatively connected to said first orifice-defining member, to slide said first orifice-defining member toward said second orifice-defining member a first distance with respect to said frame, and a linkage operatively connected between said first and second orifice-defining members to simultaneously slide said second orifice-defining member toward said first orifice-defining member a second distance that is substantially equal to said first distance.

13. The improvement according to claim 12, wherein said first and second distances are determined by the width of said loaf.

14. The improvement according to claim 1, further comprising:

a third orifice-defining member and a fourth orifice-defining member mounted together slidably on said frame, together defining a further orifice therebetween, said further orifice in registry with said opening of said frame and arranged to receive a further loaf therethrough for slicing, said further orifice arranged side-by-side with said orifice; and a further adjustment mechanism operatively connected to said frame and to each of said third and fourth orifice-defining members, said further adjustment mechanism when adjusted changes a further orifice dimension between said third and fourth orifice-defining members without substantially changing a centerline location of said further orifice.

15. The improvement according to claim 14, wherein said adjustment mechanism comprises a movement conversion means and a driving means, said driving means arranged to move in a first direction and in an opposite second direction, and said movement conversion means coordinated with said driving means to draw said first and second orifice-defining members together when said driving means moves in said first direction and to separate said first and second orifice-defining members when said driving means moves in said second direction; and wherein said further adjustment mechanism comprises a further movement conversion means and a further driving means, said further driving means arranged to move in a third direction and in an opposite fourth direction, and said further movement conversion means coordinated with said further driving means to draw said third and fourth orifice-defining members together when said further driving means moves in said third direction and to separate said third and fourth orifice-defining members when said further driving means moves in said fourth direction.

16. The improvement according to claim 15, wherein said driving means comprises an elongated member and said improvement comprises a pneumatic cylinder having an extendable rod engaged to a portion of said elongated member, extension of said rod under pneumatic pressure drives said elongated member in said first direction to draw said first and second orifice-defining members together; and wherein said further driving means comprises a further elongated member and said improvement comprises a further pneumatic cylinder having a further extendable rod engaged to a portion of said further elongated member, extension of said further extendable rod under pneumatic pressure drives said further elongated member in said third direction to draw said third and fourth orifice-defining members together.

17. The improvement according to claim 16, wherein said movement conversion means comprises a link pivotally connected to said frame and operatively connected at one end to said first orifice-defining member and at an opposite end to the second orifice defining member; and wherein said further movement conversion means comprises a further link pivotally connected to said frame and operatively connected at one end to said third orifice-defining member and at an opposite end to said fourth orifice defining member.

18. In a slicing machine for slicing loaves having a moving slicing blade and an orifice plate adjacent to a cutting path of the blade, the improvement comprising an orifice assembly having:

a frame defining an opening;

a first orifice-defining member and a second orifice-defining member mounted together slidably on said frame, together defining an orifice therebetween;

an adjustment mechanism operatively connected to said frame and to each of said first and second orifice-defining members, said adjustment mechanism when adjusted changes the orifice dimension between said first and second orifice-defining members without substantially changing a centerline location of said orifice;

wherein said adjustment mechanism comprises a stud connected to said first orifice-defining member, and at least one link pivotally mounted to said frame, said stud engaged to one end of said link and said second orifice-defining member engaged to a respective other end of said link such that an inward movement of said stud pivots said link to draw said second orifice-defining member toward said first orifice-defining member; and wherein said adjustment mechanism comprises two links, each link pivotally connected to said frame on opposite sides of said stud, and two rods fixed to said second orifice-defining member on opposite sides of said stud, outside ends of said links engaged to heads of said rods and inside ends of said links engaged to said stud, inward movement of said stud drawing said rods outwardly to cause said first orifice-defining member and said second orifice-defining member to slide toward each other to decrease a width of said orifice.

* * * * *